US007851025B2

(12) United States Patent
Lawlor

(10) Patent No.: US 7,851,025 B2
(45) Date of Patent: Dec. 14, 2010

(54) SILICATE TREATMENT OF SEALED ANODIZED ALUMINUM

(75) Inventor: John Lawlor, Northants (GB)

(73) Assignee: Henkel AG & Co. KGaA, Duesseldorf (DE)

( * ) Notice: Subject to any disclaimer, the term of this patent is extended or adjusted under 35 U.S.C. 154(b) by 245 days.

(21) Appl. No.: 11/769,332

(22) Filed: Jun. 27, 2007

(65) Prior Publication Data

US 2008/0032121 A1 Feb. 7, 2008

(30) Foreign Application Priority Data

Jun. 30, 2006 (EP) ..... 06013572

(51) Int. Cl.
*B05D 7/14* (2006.01)

(52) U.S. Cl. ..... 427/409; 427/412.9; 205/220

(58) Field of Classification Search ..... 427/402, 427/409, 419.2; 205/220, 223, 704, 724, 205/735, 736, 740, 741
See application file for complete search history.

(56) References Cited

U.S. PATENT DOCUMENTS

| | | | | |
|---|---|---|---|---|
| 2,714,066 | A | 7/1955 | Jewett et al. | |
| 3,181,461 | A * | 5/1965 | Fromson | 430/275.1 |
| 3,374,155 | A | 3/1968 | Weber | |
| 4,492,616 | A * | 1/1985 | Pliefke et al. | 205/214 |
| 5,411,607 | A * | 5/1995 | Basaly et al. | 148/272 |
| 5,811,218 | A | 9/1998 | Kaii et al. | |
| 5,919,297 | A * | 7/1999 | Chavannes | 106/287.23 |
| 6,686,053 | B2 | 2/2004 | Wada et al. | |

FOREIGN PATENT DOCUMENTS

| | | | |
|---|---|---|---|
| BE | 664258 | | 11/1965 |
| EP | 0 193 964 | B1 | 7/1989 |
| EP | 0 799 717 | B1 | 11/1999 |
| EP | 1 236 815 | A2 | 9/2002 |
| EP | 1 064 332 | B1 | 6/2003 |
| EP | 1 625 944 | A1 * | 2/2006 |
| EP | 1 873 278 | A1 * | 1/2008 |
| GB | 926 418 | | 5/1963 |
| JP | 02-175299 | A * | 7/1990 |
| JP | 2003-136853 | A * | 5/2003 |
| WO | WO 01/34872 | A1 * | 5/2001 |

OTHER PUBLICATIONS

Ullmann's Encyclopedia of Industrial Chemistry, 5$^{th}$ Edition, vol. 9, pp. 174-176 (1987).
T. W. Jelinek, Oberflaechenbehandlung von Aluminum, Eugen G. Leuze Verlag, Ch. 6.1.3.1 (1997).
Aluminium and aluminium alloys—Anodizing—Part 1:Method for specifying decorative and protective anodic oxidation coatings on aluminium, BS EN 12373-1:2001 which supersedes BS1615:1972, European Standard, pp. 3-27, May 2001.

* cited by examiner

*Primary Examiner*—William Philip Fletcher, III
(74) *Attorney, Agent, or Firm*—Mary K. Cameron

(57) ABSTRACT

The present invention describes a method for the post-treatment of fully sealed anodized aluminum parts, especially for the automotive industry, characterized in that an aqueous silicate solution is applied to fully sealed anodized aluminum layers, where said fully sealed anodized aluminum layer has a film thickness of at least 5 μm and a film weight of at least 13 g/m$^2$, respectively. Said solution preferably contains an alkali metal (M) silicate with not more than 2.0 wt.-% of $SiO_2$, in which the ratio of $SiO_2$:$M_2O$ is preferably not more than 2. This treatment increases the alkaline stability according to the standardized corrosion tests in the automotive industry without any further treatment or organic coating applied to said treated aluminum surface.

12 Claims, No Drawings

SILICATE TREATMENT OF SEALED ANODIZED ALUMINUM

CROSS REFERENCE TO RELATED APPLICATIONS

This application claims priority under 35 U.S.C. §119 of EP06013572.0, filed Jun. 30, 2006.

BACKGROUND OF THE INVENTION

The present invention describes a method for the post-treatment of fully sealed anodized aluminum parts, especially for the automotive industry. An aqueous silicate solution is applied to a fully sealed anodized aluminum layer having a film thickness of at least 5 μm and a film weight of at least 13 $g/m^2$, respectively. The solution preferably contains an alkali metal (M) silicate with not more than 2.0 wt.-% of $SiO_2$, in which the ratio of $SiO_2$:$M_2O$ is preferably not more than 2. This treatment increases the alkaline stability according to the standardized corrosion tests in the automotive industry without any further treatment or organic coating applied to said treated aluminum surface.

The electrochemical formation of oxide layers on aluminum is a well-known and widely used industrial procedure to produce protective and/or decorative coatings on aluminum and/or aluminum alloys. Electrolytically produced aluminum oxide layers protect the base metal from corrosion and weathering and furthermore may increase the surface hardness and the abrasive resistance of the aluminum part.

The different processes of anodizing are described briefly in Ullmann's Encyclopedia of Industrial Chemistry, $5^{th}$ Edition, Vol. 9 (1987), pp. 174- 176. Anodizing of the aluminum material can be accomplished by standardized methods in electrolytes such as sulfuric acid (Eloxal GS), chromic acid (Bengough-Stuart), phosphoric acid (Boeing) and oxalic acid (Eloxal GX). The Eloxal GS method applies direct current densities of 0.5-3 $A/dm^2$ at voltages between 18-21 V and a bath temperature of 10-25° C. Through this treatment, film thicknesses of the anodized aluminum oxide layer of approximately 45 μm can be obtained, which is a maximum film thickness determined by the equilibrium of the oxide formation rate and its dissolution rate in the sulfuric acid solution at the specific process parameters chosen.

Such anodized aluminum layers are comprised of 1) a thin compact layer on top of the base metal that acts as a primary barrier coating against corrosive attack, which is only up to 2% of the overall layer thickness, and 2) a porous and amorphous oxide layer as the main constituent of the anodized layer. The porosity of the anodized layer may be favorable for the adhesion of further applied organic coatings, but exhibits a major drawback, namely the lack of protection against corrosive media rendered by the anodized aluminum. Therefore, and to impart maximum corrosion stability, the anodized aluminum layers have to be sealed in a subsequent process step. During sealing, which might be a hot sealing and/or cold sealing process, the aluminum oxide becomes hydrated and is transformed from its amorphous, essentially water-free constitution to the boehmite structure. This transformation is accompanied by a volume expansion or swelling of the oxide that in turn procures the sealing of the porous structure. Hot sealing of the anodized layer is usually performed in hot water or in steam, whereas the cold sealing process is operated at temperatures close to 30° C. in the presence of nickel fluoride. Sealing improves the corrosion resistance and resistance to weathering of anodized aluminum parts in a pH range from 5-8 (T. W. Jelinek, Oberflächenbehandlung von Aluminum, Eugen G. Leuze Verlag, 1997, ch. 6.1.3.1)

In the prior art, treatment of aluminum surfaces with silicate solutions is well known. For example, the sealing of porous anodized aluminum surfaces to increase corrosion resistance is described in U.S. Pat. No. 6,686,053. Hydrophilizing the aluminum surface in lithographic printing technologies is described in U.S. Pat. Nos. 3,181,461, and 2,714,066. In these areas of application, silicate treatment is favorable due to the strong affinity of aluminum and silicon to form a mixed oxide. Thus, aqueous silicate solutions support sealing anodized aluminum by precipitating and forming mixed oxides within the pores of the coating and in hydrophilizing aluminum oxide surfaces by the formation of thin layers comprising silicon dioxide on top of the aluminum oxide.

To improve the corrosion resistance of sealed anodized aluminum surfaces, metal complexes of zirconium- and/or titanium (EP 0193964) and dispersed particulate matter like silicon dioxide and/or aluminum oxide (EP 1064332) have been added to the aqueous silicate solution. Nevertheless, these post-treatments cannot prevent the anodic aluminum oxide film from being stripped away in corrosive environments with a high pH. This is especially the case when aluminum parts of car bodies are being exposed to detergent solutions in vehicle wash stations which might have a pH of 12.5-13.5. As aluminum gathers more importance as a construction material in the automotive industry, manufacturers have started to issue test standards (AUDI TL212, VOLVO TR31804674) to their suppliers in order to reject anodized aluminum parts with low alkaline resistance. Thus, there is a need for anodized aluminum surfaces and treatments for such surfaces that pass these alkali tests.

The post-treatment of sealed anodized aluminum with aqueous silicate solutions in order to hydrophilize the aluminum surface for lithographic printing is disclosed in U.S. Pat. No. 5,811,218. The corrosion resistance of the silicate treated anodized and sealed aluminum layer, which is a prerequisite for a metal to fulfill the standards of the automotive industry, is neither discussed nor revealed in U.S. Pat. No. 5,811,218. Due to the fact that the subject matter of this document is not related to the use of aluminum parts in the automotive industry, the aluminum oxide layers described therein are much thinner (1-8 $g/m^2$) and the sealing time per micron much shorter (65 seconds/μm) than needed to meet the specific requirements and quality standards of the automotive industry.

EP 1625944 characterizes a silicate treatment of sealed and unsealed anodized aluminum plates for lithographic printing, which is first aimed to hydrophilize and/or seal the aluminum oxide surface, and secondly to enhance the resistance of the lithographic printing plate against dissolution by the alkaline developer. Here, a sealing ratio (SR) of the anodized aluminum layer of at least 50% is proposed before the hydrophilizing step, including the silicate treatment, can be performed. The treatment according to EP 1625944 is not sufficient to provide the alkaline and corrosion resistance that is mandatory in the automotive industry. EP 1625944 does not reveal the resistance of their layers exposed to an aqueous alkaline solution that contains corrosive agents such as halide ions.

Surprisingly, the present inventor found that treatment of a sealed anodized aluminum layer with an aqueous silicate solution according to the invention described herein provides improved alkaline stability. Specifically, an alkaline stability of the aluminum material for at least 10 minutes, preferably for at least 14 minutes and most preferably for at least 16 minutes at a temperature of 23±2° C. in a solution containing a mixture of 0.2 wt.-% sodium phosphate and 0.02 wt.-% sodium chloride and sodium hydroxide with a pH value of at least 11.5, preferably at least 12.5, but not higher than 13.5 was produced when the aluminum material was processed according to the inventive process.

Within this invention, alkaline and corrosive stability of the aluminum material is defined on the basis of a standardized testing method introduced in the automotive industry whereupon the visual appearance of the aluminum material after a defined exposure to the aforesaid alkaline testing solution that contains a mixture of 0.2 wt.-% sodium phosphate and 0.02 wt.-% sodium chloride and sodium hydroxide with a pH value of at least 11.5 is evaluated. The classification system of the standardized corrosion tests AUDI TL212 and VOLVO TR31804674 covers the following specifications of the visual appearance of the aluminum material after exposure to such a testing solution in the order of increasing corrosive damage:

Grade 0: no visible change in appearance
Grade 1: slight dulling of luster
Grade 2: light etch
Grade 3: etch of substrate
Grade 4: heavy etch
Grade 5: very heavy etch of substrate Quality results of at most Grade 2 after 16 minutes of exposure to a solution with a pH of 12.5 are considered to be sufficiently alkaline-stable according to the guidelines of AUDI TL212 and VOLVO TR31804674.

As a part of the invention, the treatment of the sealed anodized aluminum layer with an aqueous silicate solution is applied within a sequential process of surface finishing of an aluminum material that is comprised of:

a) cleaning and/or electro-polishing and/or desmutting an aluminum material;
b) anodizing the aluminum material up to a film thickness of at least 5 μm;
c) cold sealing or hot sealing of the anodized aluminum material up to a sealing ratio (SR) of at least 90%, preferably 95%, and most preferably 99%;
d) treatment of the sealed anodized aluminum material with an aqueous silicate solution with or without rinsing and/or drying in between the listed process steps and with or without applying an organic coating to the aluminum after the process step d) has been accomplished.

The scope of the invention also includes an aluminum material produced by treating the surface thereof sequentially by the following process steps:

a) anodizing an aluminum material up to a film thickness of at least 5 μm;
b) sealing of the anodized aluminum material up to a sealing ratio (SR) of at least 90%, preferably 95% and most preferably 99%;
c) treatment of the sealed anodized aluminum material with an aqueous silicate solution, whereupon the aluminum material treated in that way shows at most a light etch (Grade 2) in appearance after exposure to an alkaline testing solution with a pH value of at least 11.5, preferably at least 12.5, but not higher than 13.5 for at least 10 minutes, preferably at least 14 minutes and most preferably at least 16 minutes at a temperature of 23±2° C.

The aluminum material according to this invention may be used in exterior applications such as a building material for window frames, doors and claddings, and preferably used in the automotive industry as a member of vehicle bodies and/or vehicle wheels.

The aluminum material used for the silicate treatment and/or within the process of aluminum surface finishing according to this invention is selected from pure aluminum containing at least 99 wt.-% aluminum or aluminum alloyed with copper, manganese, titanium, silicon, zinc and preferably magnesium where the magnesium content is preferably not more than 5 wt.-% and most preferably not more than 1 wt.-%.

Preferably, the aqueous silicate solution used according to the present invention contains not more than 2.0 wt.-% of $SiO_2$, more preferably not more than 1.0 wt.-%, and most preferably not more than 0.5 wt.-%, but not less than 0.05 wt.-% $SiO_2$ and more preferably not less than 0.1 wt.-%.

Furthermore, the silicate solution is preferably comprised of an alkali metal (M) silicate such as potassium silicate, lithium silicate and more preferably sodium silicate, where said aqueous solution preferably exhibits a molar ratio of $SiO_2$:$M_2O$, that is not more than 2, more preferably not more than 1.5, but not less than 0.5 and most preferably equals 1. The pH value does not need to be adjusted and thus may be left at the value provided by the dissolved silicate.

Optimized conditions for the silicate treatment are maintained, when said treatment is performed at a temperature of at least 40° C., preferably at least 50° C., but not higher than 90° C. and preferably not higher than 70° C., and most preferably at 60° C., and said treatment is performed for at least 10 seconds, preferably at least 80 seconds, but not more than 300 seconds, preferably not more than 160 seconds and most preferably for 120 seconds.

Furthermore, it is beneficial to the appearance of the aluminum part after the treatment according to this invention that the silicate treatment solution contains a wetting agent, preferably anionic and/or nonionic surfactants in a concentration of preferably at least 50 ppm, more preferably at least 200 ppm, but preferably not more than 1000 ppm and more preferably not more than 600 ppm.

The nonionic surfactant can be one or more selected from the group of alkoxylated, preferably ethoxylated or propoxylated, branched or straight alkyl alcohols or branched or straight arylalkyl alcohols or branched or straight fluoroalkyl alcohols or branched or straight alkyl amines or from the group of alkylpolyglycosides. The alkyl moiety of the selected nonionic surfactant consists preferably of at most 18, more preferably of at most 12, but at least 6 carbon atoms. Nonlimiting examples of suitable surfactants are sold under the trade names Triton®, Tergitol®, Merpol® and Zonyl®. The anionic surfactant can be one or more selected from the group of branched or straight alkyl or alkylaryl or alkylpolyether sulfates and/or sulfonates and/or phosphonates preferably with not more than 12 carbon atoms in the alkyl chain.

EXAMPLES

Example 1

An aluminum part (AlMg1, AlMg0.5) was anodized under constant current conditions in a sulfuric acid medium at a direct current density of 1-2 A/dm$^2$ (DC voltage approx. 12-20 V) and was subjected thereupon to a cold sealing and a subsequent hot sealing procedure. The cold sealing was performed for 800 seconds followed by a hot rinse/sealing step for another 800 seconds. According to this sealing process a sealing ratio of the anodized aluminum surface of at least 90% was attained, which accounts for a total sealing rate of approx. 200 seconds/μm or 67 seconds/gm$^{-2}$, respectively.

Test Procedure

The testing of the sealed anodized aluminum surfaces is performed with the dye absorption test according to Scott described within the British Standard BS1615:1972 (Anodic oxidation coatings on aluminum). This standard test allows one to quantify the degree of surface sealing by measuring the coloring of the aluminum surface photometrically. For that purpose, one drop of a 4.6 wt.-% sulfuric acid solution, which contains additionally 1 wt.-% potassium fluoride, is applied to the cleaned anodized aluminum surface for one minute. After this treatment, the aluminum surface is cleaned and thereupon exposed at the same spot for one further minute to an aqueous coloring solution of the specific dye Aluminum Fast Red B3LW. The coloring of the anodized aluminum surface can be quantified by measuring the residual optical reflectivity with a reflection photometer. The residual optical reflectivity is given by the ratio of the reflective light intensity measured with the probe head of the photometer at the dyed surface spot to the reflective light intensity of the untreated anodized aluminum surface. The capability of the aluminum oxide surface to absorb the specific dye is directly related to the free surface that is provided by the amorphous aluminum oxide layer. Thus, the free surface and the photometrically measured reflective light intensity are closely related to each other, such that the sealing ratio (SR) can be expressed according to Formula I:

$$SR = \left(1 - \frac{S_{seal} - S_{geom}}{S_{anod} - S_{geom}}\right) \times 100\% \cong \left(1 - \frac{R_{seal}}{R_{anod}}\right) \times 100\% \quad (1)$$

with $S_{anod}$, $R_{anod}$ being the surface area and reflective light intensity, respectively, after anodizing the aluminum material; $S_{seal}$, $R_{seal}$ being the surface area and reflective light intensity, respectively, after sealing of the anodized aluminum material; and $S_{geom}$ being the geometric surface area of the aluminum material. From a technical point of view, anodized aluminum layers are considered to be "fully" sealed when a sealing ratio of at least 90% is realized as defined by Formula I.

In Example 1, the film thickness of the sealed anodized aluminum part with a sealing ratio of at least 90% was about 8 μm, which corresponds to a film weight of approximately 21 $g/m^2$ considering a density of the sealed aluminum oxide layer of $\rho$=2.6 $g/cm^3$ according to the British Standard BS1615:1972 (Anodic oxidation coatings on aluminum). The film thickness of the sealed anodized aluminum oxide layer was determined by using an eddy current instrument (Isoscope® MP30, Fischer GmbH) calibrated with a reference sample of the same material.

Anodized aluminum parts sealed according to the procedure of Example 1 were immersed for 120 seconds at 60° C. in aqueous sodium metasilicate solutions with varying $SiO_2$ content and afterwards rinsed with deionized water and dried at ambient room temperature.

The quality of the aluminum parts prepared according to Example 1 with respect to their visual appearance directly after the silicate treatment and to their alkaline stability after immersing the aluminum part for 16 minutes in a chloride containing aqueous solution at pH 12.5 was determined.

Appearance of sealed anodized aluminum (AlMg1, AlMg0.5) treated for 120 seconds at 60° C. with a sodium metasilicate solution and appearance of said treated aluminum after 16 minutes of immersion in standard test solution at pH 12.5 containing NaOH, 0.2 wt.-% $Na_3PO_4$ and 0.02 wt.-% NaCl according to the specification (grade 0-5) of the standardized corrosion test (AUDI TL212/VOLVO TR31804674).

TABLE 1

| $SiO_2$/wt.-% | appearance | appearance |
|---|---|---|
| 0 | ○ | 3-4 |
| 0.05 | + | 2-3 |
| 0.25 | ++ | 0 |
| 0.5 | – | 0 |

○ neutral/+ good/++ very good/– worse

The results in Example 1 reveal that the preferred embodiment of the invention contains 0.25 wt.-% $SiO_2$ in the form of an aqueous sodium metasilicate solution. The aqueous solution containing 0.5 wt.-% $SiO_2$ gave optimum alkaline and corrosive stability results, but the optical appearance of the treated aluminum part after rinsing with deionized water and drying at ambient room temperature was inferior to the one obtained from more diluted sodium metasilicate solutions.

Example 2

Example 2 shows the effect of surfactants added to the silicate treatment solution on the appearance of the sealed anodized aluminum part treated accordingly to this invention. The appearance is evaluated by means of brightness and stainlessness of the surface directly after this treatment, as compared to a reference treatment which is denoted in Table 2 for providing a neutral (o) appearance (refers also to Example 1). In a specific embodiment of the invention, where a combination of anionic (A) and non-ionic (B) surfactants was added to the silicate treatment solution, an improved wettability, cleaning and rinse-off behavior of the aluminum surface, without any deterioration of the performance of said treated aluminum part in the standardized corrosion test, was achieved.

Appearance of sealed anodized aluminum (AlMg1, AlMg0.5) treated for 120 seconds at 60° C. with a sodium metasilicate solution (0.5 wt.-%) containing disodium lauryl diphenylether disulfonate (A) and tetraethylene glycol monooctylether (B) as well as appearance according to the specifications of the standardized corrosion test (see Example 1).

TABLE 2

| A/ppm | B/ppm | grade 0-5 | appearance |
|---|---|---|---|
| 50 | 10 | 0 | ○ |
| 100 | 20 | 0 | + |
| 200 | 40 | 0 | ++ |
| 500 | 100 | 0 | ++ |
| 1000 | 200 | 1 | + |

○ neutral/+ good/++ very good

According to these embodiments of the invention a process for the treatment of an anodized aluminum material is hereby disclosed which complies with the high quality standards of the automotive industry without any further treatment or organic coating applied to said treated aluminum surface. These standards are especially introduced to avoid corrosive damages of the aluminum parts of car bodies during cleaning procedures especially in assembly lines and car-wash plants and during hand-guided cleaning. Thus, the advantage of the silicate treatment of fully sealed anodized aluminum is demonstrated in an excellent alkaline and corrosive stability of the aluminum material treated according to this invention even in a highly corrosive environment, e.g. in the presence of chloride ions. Moreover, the treatment can be easily adopted in state-of-the-art processes of aluminum surface finishing.

What is claimed is:

1. A method for treating a sealed anodized aluminum material, comprising the step of:

applying an aqueous silicate solution to a surface of a sealed anodized aluminum material, said surface comprising a sealed anodized layer having a film thickness of at least 5 μm and a sealing ratio (SR) of at least 90%; wherein the sealed anodized aluminum material is a vehicle wheel or a member of a vehicle body.

2. The method according to claim 1, wherein the aqueous silicate solution comprises not more than 2.0 wt.-% of $SiO_2$ but not less than 0.05 wt.-% $SiO_2$.

3. The method according to claim 2, wherein the aqueous silicate solution comprises not more than 1.0 wt.-% of $SiO_2$.

4. The method according to claim 3, wherein the aqueous silicate solution comprises an alkali metal (M) silicate and exhibits a molar ratio of $SiO_2$:$M_2O$, that is not more than 2, but not less than 0.5.

5. The method according to claim 1, wherein the aqueous silicate solution comprises not more than 0.5 wt.-% of $SiO_2$ but not less than 0.1 wt.-% $SiO_2$.

6. The method according to claim 1, wherein the aqueous silicate solution comprises an alkali metal (M) silicate and exhibits a molar ratio of $SiO_2$:$M_2O$, that is not more than 2, but not less than 0.5.

7. The method according to claim 1, wherein application of the aqueous silicate solution is performed at a temperature of 40° C. to 90° C. for a time of 10 to 300 seconds.

8. The method according to claim 1, wherein the aqueous silicate solution additionally comprises a wetting agent in a concentration of 20 to 1000 ppm.

9. The method according to claim 8, wherein the wetting agent is present in a concentration of 100 to 500 ppm and comprises a combination of anionic and nonionic surfactants.

10. The process according to claim 8 wherein:

a) the anionic surfactant is one or more selected from the group consisting of alkyl, alkylaryl, alkylpolyether sulfates, sulfonates and phosphonates; and b) the nonionic surfactant is one or more selected from the group consisting of alkoxylated alkyl alcohols, arylalkyl alcohols, fluoroalkyl alcohols, alkyl amines and alkylpolyglycosides.

11. A process of surface finishing an aluminum material comprising subjecting the aluminum material to sequential treatment steps comprised of:

a) optionally, cleaning and/or electro-polishing and/or desmutting an aluminum material;

b) anodizing the aluminum material to form an anodized aluminum surface having an anodized film thickness of at least 5 μm;

c) cold sealing said anodized aluminum surface;

d) after step c) hot sealing the anodized aluminum surface thereby forming a sealed anodized aluminum surface having a sealing ratio (SR) of at least 90%;

e) treating the sealed anodized aluminum surface with an aqueous silicate solution comprising 0.05 to 0.5 wt.-% $SiO_2$, 100 to 500 ppm of an anionic surfactant selected from the group consisting of alkyl, alkylaryl, alkylpolyether sulfates, sulfonates and phosphonates; and 20 to 100 ppm of a nonionic surfactant selected from the group consisting of alkoxylated alkyl alcohols, arylalkyl alcohols, fluoroalkyl alcohols, alkyl amines and alkylpolyglycosides.

12. The process according to claim 11 wherein disodium lauryl diphenylether disulfonate is present as the anionic surfactant and tetraethylene glycol monooctylether is present as the nonionic surfactant.

* * * * *